US006786583B2

(12) United States Patent
Ota et al.

(10) Patent No.: US 6,786,583 B2
(45) Date of Patent: Sep. 7, 2004

(54) INK CARTRIDGE STORAGE STRUCTURE AND METHOD

(75) Inventors: Mutsuhiko Ota, Nagano-ken (JP); Yukiharu Suda, Nagano-ken (JP); Hisashi Koike, Nagano-ken (JP); Satoshi Shinada, Nagano-ken (JP); Michinari Tsukahara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/231,455

(22) Filed: Aug. 30, 2002

(65) Prior Publication Data

US 2003/0085967 A1 May 8, 2003

(30) Foreign Application Priority Data

Aug. 30, 2001 (JP) ..... 2001-261172

(51) Int. Cl.[7] ..... B41J 2/175
(52) U.S. Cl. ..... 347/86; 347/108
(58) Field of Search ..... 347/85, 86, 87, 347/108; 206/205, 461, 469, 479

(56) References Cited

U.S. PATENT DOCUMENTS

| | | | | |
|---|---|---|---|---|
| 5,381,172 A | | 1/1995 | Ujita et al. | |
| 5,801,737 A | * | 9/1998 | Sato et al. | 347/86 |
| 5,812,166 A | * | 9/1998 | Yamazaki | 347/87 |
| 6,220,702 B1 | * | 4/2001 | Nakamura et al. | 347/86 |
| 6,250,746 B1 | * | 6/2001 | Ito et al. | 347/86 |
| 6,502,701 B2 | | 1/2003 | Shinada | |

FOREIGN PATENT DOCUMENTS

| | | | |
|---|---|---|---|
| EP | 0 627 317 A1 | 7/1994 | |
| EP | 0812693 | * 12/1997 | B41J/2/17 |

* cited by examiner

*Primary Examiner*—Anh T. N. Vo
(74) *Attorney, Agent, or Firm*—Sughrue Mion, PLLC

(57) ABSTRACT

An ink cartridge storage structure and method provide consistent print density and quality by mixing the ink when the cartridge is removed from the packaging and installed to a printer for use. An ink-filled ink cartridge with an ink supply port installable to the head of a printer is stored inside an individual box made to hold the ink cartridge. The ink cartridge is stored inside the individual box so that the ink supply port is at the top when the box is in the normal upright position.

23 Claims, 11 Drawing Sheets

INK CARTRIDGE STORAGE STRUCTURE AND METHOD

BACKGROUND OF THE INVENTION

1. Field of the Invention

The present invention relates to a structure and method for storage of an ink cartridge used to supply ink to the recording head of a recording apparatus.

2. Description of Related Art

A related art inkjet recording apparatus (i.e., "printer") generally has a recording head mounted on a carriage, and moves widthwise to the paper or other recording medium. The related art inkjet also includes a paper transportation mechanism for transporting the paper relative to the recording head in a direction perpendicular to the direction of recording head travel.

This related art inkjet printer prints to the recording medium by discharging ink droplets from the recording head based on the print data. If a recording head capable of discharging various colors of ink, such as black, yellow, cyan, and magenta, is mounted on the carriage, the inkjet printer can print in full color by adjusting the discharge ratio of the different ink colors, and is thus not limited to printing text with black ink.

An ink cartridge for supplying the ink to the recording head is therefore located inside the printer. In a related art inkjet printer, related art ink cartridges containing black, yellow, cyan, and magenta ink are installed to a carriage and move with the carriage.

The related art ink cartridges (i.e., ink-filled ink cartridges) are normally stored in the package with the side mounted to the recording head, that is, the ink supply port side, down. The package is also not vertically inverted for store display purposes and shipping. Therefore, the related art ink cartridge is left with the ink supply port positioned on the bottom for long periods of time.

Accordingly, the related art ink cartridge has various problems and disadvantages. For example, but not by way of limitation, when the ink cartridge inside the package is removed from the package and installed to the recording head of the printer, there is no change in the orientation of the ink cartridge between when it is stored and when it is installed to the recording head. Thus, the ink inside the cartridge is used without being mixed, that is, with the ink separated into a high density ink layer and a low density ink layer. This happens particularly when the ink is, for example, a pigment ink or other type of ink in which such a density gradient forms easily. The resulting problem is that only high density ink near the ink supply port is consumed when the ink is first used, and consistent print density and quality cannot be achieved.

SUMMARY OF THE INVENTION

The present invention is directed to solving at least the foregoing technical problems, and an object of the invention is to provide an ink cartridge storage structure and method whereby ink inside the ink cartridge is mixed as a result of changing the orientation of the ink cartridge by inverting the ink cartridge for installation to the recording apparatus, thereby providing consistent print density and quality when the ink is used.

To achieve these objects an ink cartridge storage structure according to the present invention has an ink-filled ink cartridge having an ink supply port installable to a recording head of a recording apparatus and an ink storage part for holding only ink, and packaging for storing the ink cartridge. The ink cartridge storage structure stores the ink cartridge in the packaging in an orientation different from the orientation in which the ink cartridge is used.

When the ink cartridge is then removed from the packaging and installed to the print head of the recording apparatus, the ink cartridge is inverted and the orientation thereof is thus changed. Thus inverting the ink cartridge mixes the ink in the ink cartridge when the cartridge is installed to the print head, and thus assures consistent print density and quality when the ink is used.

The ink cartridge is preferably stored in the packaging so that the ink supply port is positioned at the top.

Further preferably, the packaging is a vacuum pack or an individual box.

When thus comprised the ink inside the ink cartridge is mixed when the ink cartridge is removed from the vacuum pack or individual box in which it is stored and installed to the print head of the recording apparatus.

Yet further preferably, the ink storage part has an ink tank chamber and an ink end chamber.

Yet further preferably, the packaging has a hanging part with a hole therein. This enables the ink cartridge to be displayed for display or retail purposes in a desirable orientation by passing the hole in the hanging part over a peg or hangar, for example.

This assures that the ink cartridges are displayed with the ink supply port positioned at the top so that the ink inside the cartridge is mixed when the ink cartridge is removed from the packaging and installed to the head of the recording apparatus.

Yet further preferably, the packaging is packaging enabling storage in an external box for shipping.

This enables the ink cartridge packages to be stored in the external box and shipped with the ink supply ports positioned at the top. This assures that when an ink cartridge package is removed from the external box and inverted, the ink cartridge is also inverted and the ink inside the cartridge is mixed.

Yet further preferably, a label part identifying top and bottom parts of the packaging is formed on the packaging.

This makes it possible to assure that the ink cartridge is stored in the packaging in an attitude different from that in which the ink cartridge is used.

The ink in the ink cartridge is preferably a pigment ink. Even if the pigment in the ink then settles to the bottom part of the cartridge, the ink will be mixed in the cartridge when the ink cartridge is installed to the head.

An ink cartridge storage method according to the present invention has an ink-filled ink cartridge with an ink supply port installable to a recording head of a recording apparatus and an ink storage part for holding only ink, and packaging for storing the ink cartridge. The ink cartridge storage method stores the ink cartridge in the packaging so that the ink cartridge is held in an orientation different from the position in which the ink cartridge is used.

This storage method assures that there is a change in the attitude of the ink cartridge between when it is stored in the packaging and when the cartridge is installed for use.

The ink inside the cartridge is thus mixed when the ink cartridge is removed from the packaging and installed to the print head of the recording apparatus, thus assuring consistent print density and quality when the ink is used.

The ink cartridge is preferably stored in the packaging so that the ink supply port is positioned at the top.

Further preferably, the packaging is a vacuum pack or an individual box.

As with the storage structure described above, this assures that the ink inside the ink cartridge is mixed when the ink cartridge is removed from the vacuum pack or individual box in which it is stored and installed to the print head of the recording apparatus.

Yet further preferably, the ink inside the ink cartridge is a pigment ink. As with the storage structure described above, this assures that even if the ink pigment then settles to the bottom part of the cartridge, the ink will be mixed in the cartridge when the ink cartridge is installed to the head.

Yet further preferably, the ink cartridge is placed in the packaging with reference to a label part previously formed on the packaging. This makes it possible to assure that the ink cartridge is stored in the packaging in an attitude different from that in which the ink cartridge is used.

Additionally, within the ink cartridge, there is an ink path and an air path, configured to release air and ink, respectively, when the cartridge is installed to the recording head. The air path releases air into the ink path based on a negative pressure in the ink path.

The air path comprises a zigzag airflow channel configured to increase airflow resistance, a wide, recessed channel, and an air permeable film stretched over the air path to form an air permeable chamber in the cartridge.

Other objects and attainments together with a fuller understanding of the invention will become apparent and appreciated by referring to the following description and claims taken in conjunction with the accompanying drawings.

BRIEF DESCRIPTION OF THE DRAWINGS

The accompanying drawings, which are included to provide a further understanding of illustrative, non-limiting embodiments of the present invention and are incorporated in and constitute a part of this specification, illustrate embodiments of the invention and together with the description serve to explain the principles of the drawings.

DETAILED DESCRIPTION OF THE INVENTION

Reference will now be made in detail to the illustrative, non-limiting, exemplary embodiments of an ink cartridge storage structure and method, examples of which are illustrated in the accompanying drawings. In the present invention, the terms are meant to have the definition provided in the specification, and are otherwise not limited by the specification. Further advantages of these and the stated objects reside in the details of construction and operation as more fully hereinafter described and claimed, reference being made to the accompanying drawings forming a part hereof, wherein like numerals refer to like parts throughout.

The ink cartridge 1 is described first with reference to FIG. 1 to FIG. 10. The ink cartridge 1 shown in FIGS. 2(*a*) and (*b*) has a main case (i.e., bottom case) 2 with a substantially square flat shape open to one side, and a cover (i.e., top case) 3 for sealing the opening to the main case 2. The inside of the ink cartridge 1 comprises an ink path and an air path, both of which are further described below.

Figure 10:
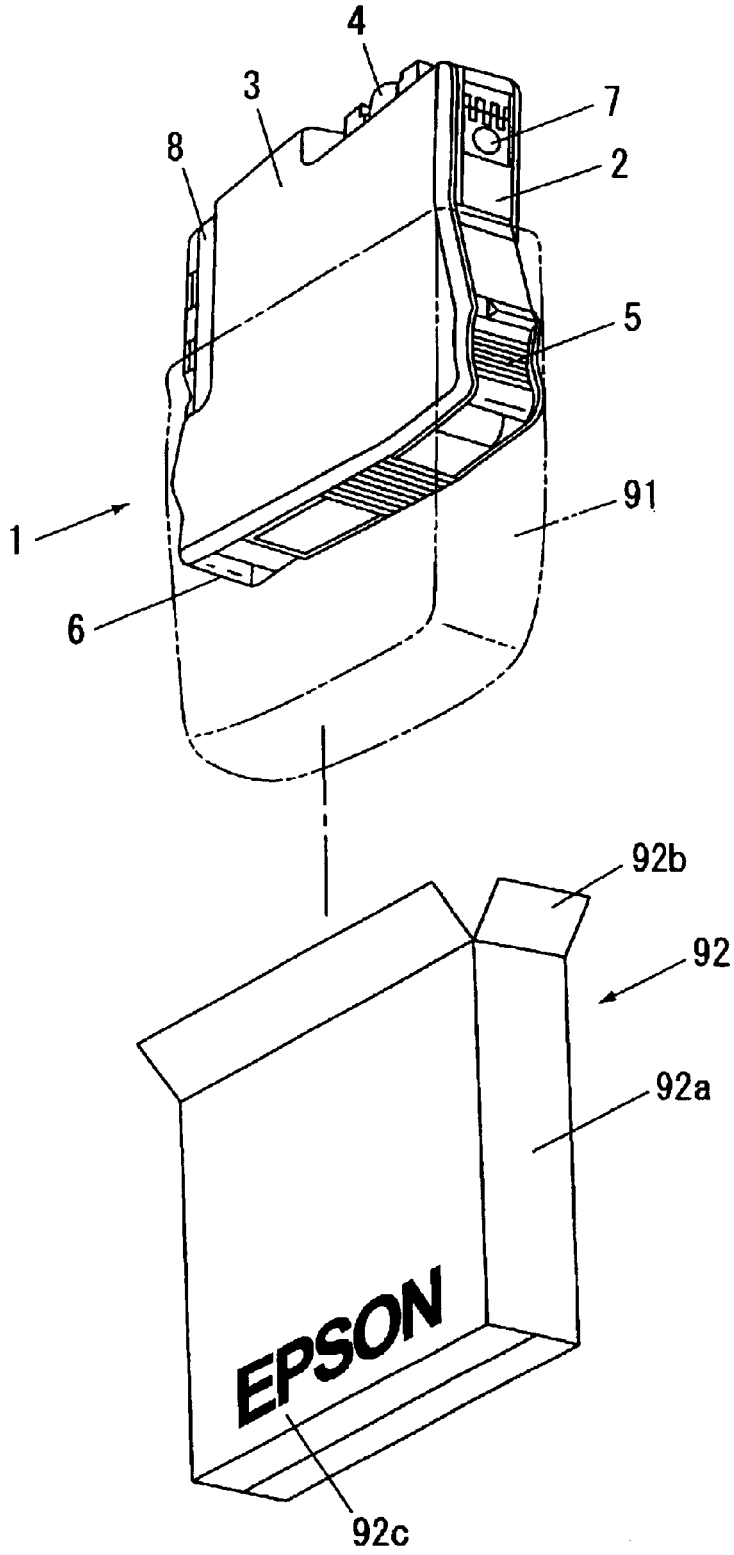
FIG. 10 is an exploded oblique view describing the ink cartridge storage structure and method of an exemplary embodiment of the invention.

This ink cartridge 1 has ink sealed therein, and is stored in a vacuum pack 91 with the ink supply port 4 positioned at the top, as shown in FIG. 10. The vacuum pack 91 is, for example (but not by way of limitation), a transparent bag. After the cartridge is inserted to the bag, air is removed from the bag so that the cartridge 1 is stored in the vacuum pack 91. By thus sealing the ink cartridge 1 in the vacuum pack 91, air is prevented from entering the cartridge until the ink cartridge 1 is removed from the ink cartridge 1 so that the ink cartridge 1 can be distributed with assured ink deaeration and cleanliness levels.

As also illustrated in FIG. 10, after the ink cartridge 1 is enclosed in the vacuum pack 91, it is then stored in the same orientation in an individual box 92 (i.e., with the ink supply port 4 up). This individual box 92 has a square body 92*a* that opens at the top, and a box top 92*b* for opening and closing the body 92*a*, thus forming a substantially square-sided box made of paperboard. A label area 92*c* on the outside of the individual box 92 is used to display information such as (but not limited to) a company name.

Figure 9:
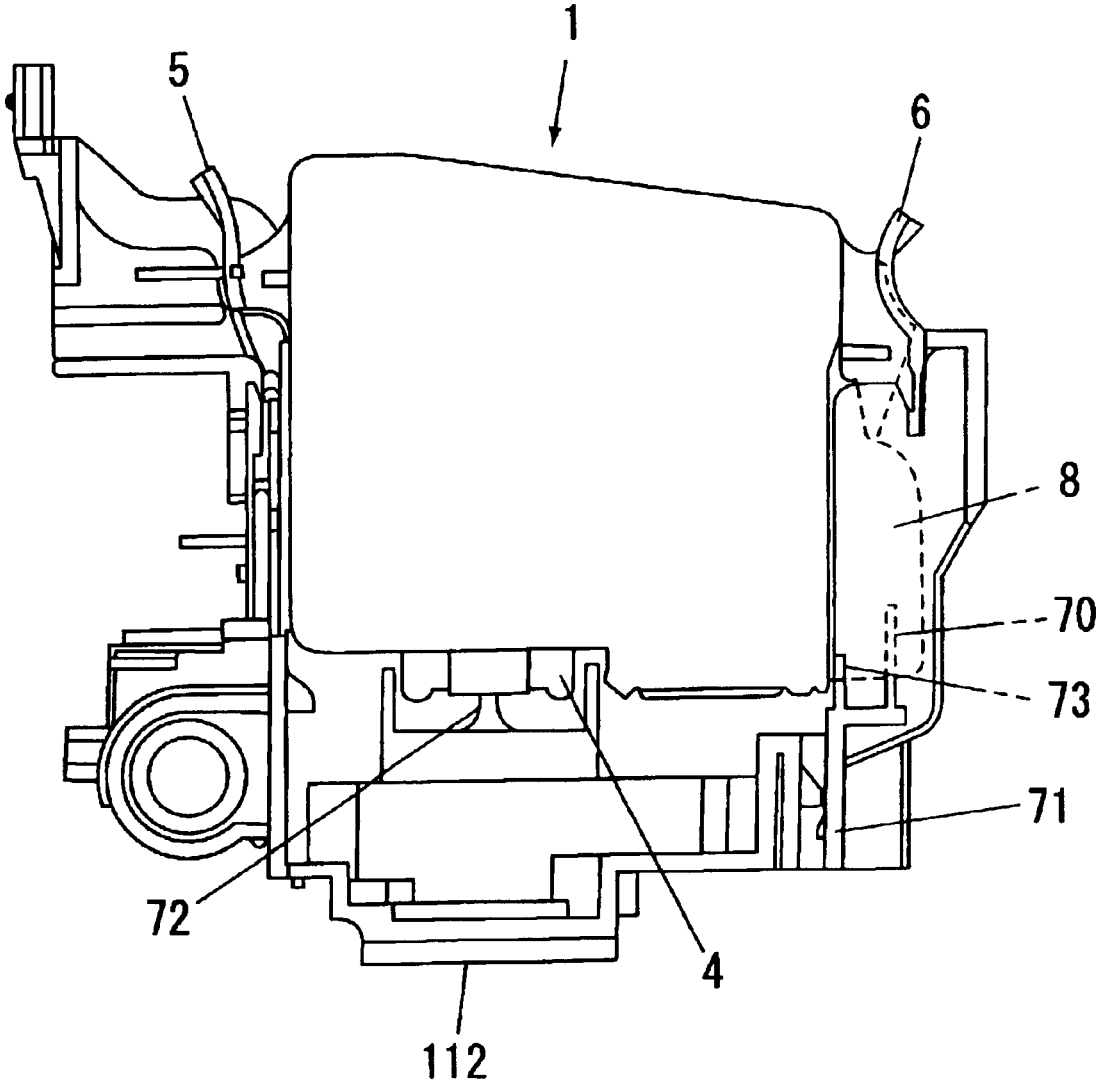
FIG. 9 is a front view of the connection of an ink cartridge to the cartridge holder according to an exemplary embodiment of the invention.

When the ink cartridge 1 stored in this individual box 92 and vacuum pack 91 is removed and installed to a recording head 112 illustrated in FIG. 9, the ink cartridge 1 is inverted to position the ink supply port 4 on the bottom, which causes the ink inside the cartridge to mix.

Provided at the bottom part of the main case 2 are the ink supply port 4, which is connectable to the ink supply needle 72 of the recording head 112 (both shown in FIG. 9), and a first opening part (open hole) 85 and second opening part 86 (both shown in FIG. 4 and FIG. 5) beside the ink supply port 4. The ink supply port 4 communicates with the ink end chamber (differential pressure value chamber) described below, and the first opening part 85 communicates with the first ink storage chamber (ink tank) 11.

Figure 1:
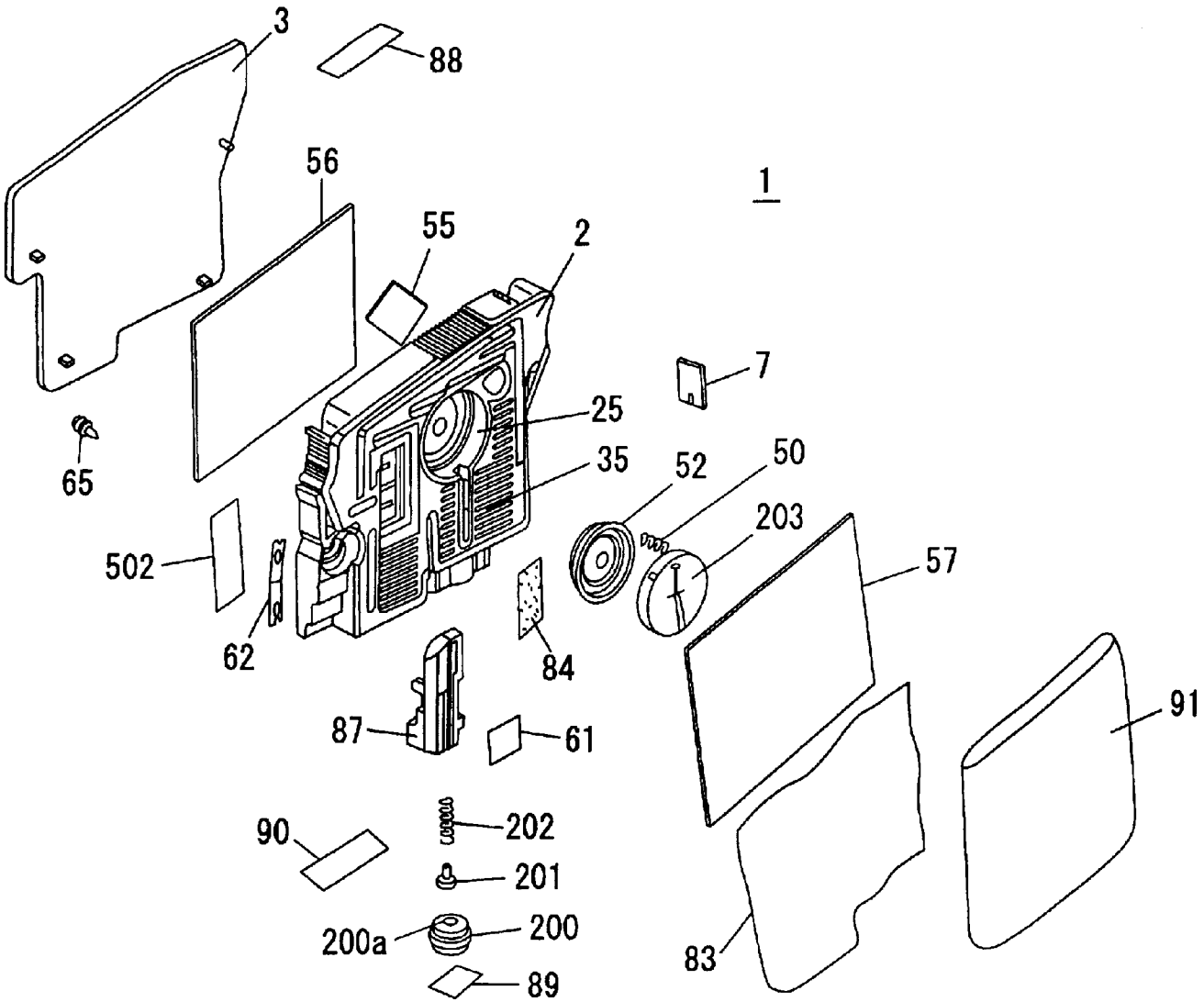
FIG. 1 is an oblique exploded view of a complete ink cartridge according to an exemplary embodiment of the invention.

As shown in FIG. 1, a substantially cylindrical seal member 200 made of rubber, for example, is fit inside the ink supply port 4. A through-hole 200*a* open in the axial direction is disposed in the middle of this seal member 200. A spring seat (valve body) 201 that opens and closes through-hole 200*a* in conjunction with insertion and removal of the ink supply needle 72 (as illustrated in FIG. 9) is disposed inside this ink supply port 4, and a compression spring 202 urging the spring seat 201 to the seal member 200 is fit elastically to the spring seat 201.

Figure 2A:
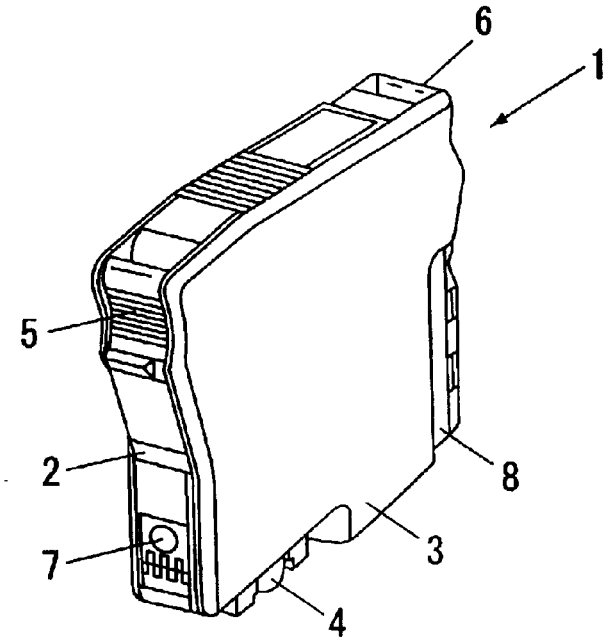
FIGS. 2(*a*) and (*b*) are oblique external views of an ink cartridge according to an exemplary embodiment of the invention.
Figure 2B:
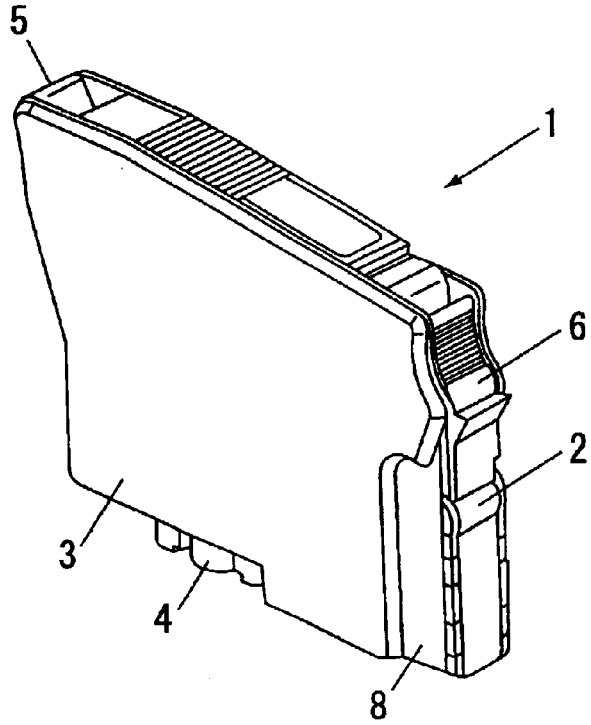

Engaging members 5 and 6 enabling mounting to and removal from the cartridge holder are disposed at the top side part of the main case 2. As shown in FIG. 2(*a*), a circuit board (IC chip) 7 is disposed at the bottom part of the one engaging member 5, and a valve chamber 8 is disposed at the bottom part of the other engaging member 6 as shown in FIGS. 2(*a*) and (*b*).

The circuit board 7 contains a writable memory device for storing ink-related information such as the color, type of ink (e.g., pigment or dye based ink), remaining ink volume, serial number, expiration date, and compatible models.

Figure 8:
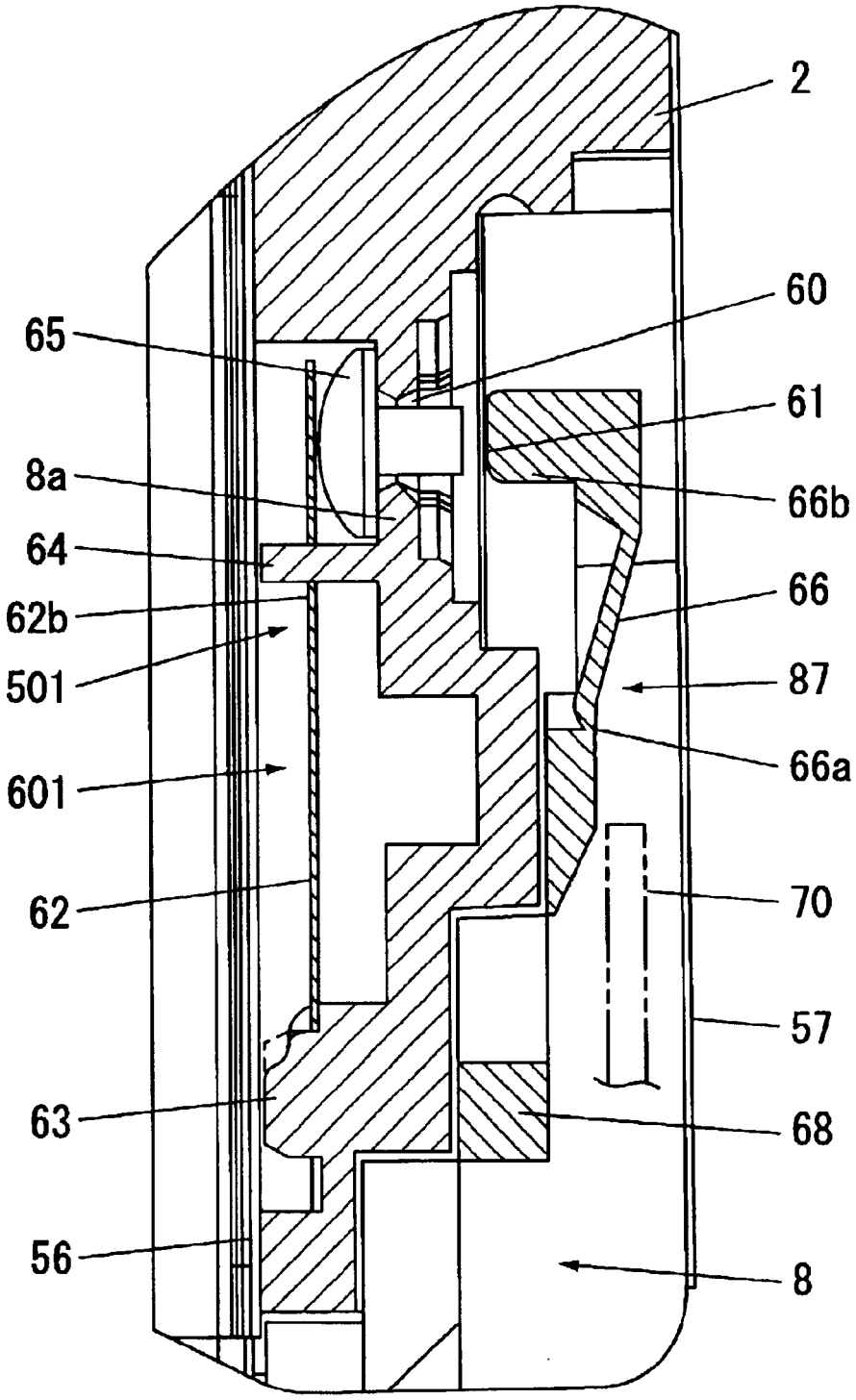
FIG. 8 is an enlarged section showing the valve storage chamber of an ink cartridge according to an exemplary embodiment of the invention.

As shown in FIG. 8, the valve chamber 8 has an internal space open to the cartridge insertion side (bottom). A valve operating rod 70 and printer-side identification piece 73 (see FIG. 9) matching the ink cartridge 1 move within this internal space. The operating arm 66 of an identification block 87 rotated in conjunction with advancement and retraction of the valve operating rod 70 is housed in the top part of this internal space. An identification protrusion 68 for determining compatibility with the printer is disposed in the bottom part of this internal space. This identification protrusion 68 is located at a position where it can determine from the valve operating rod 70 of the cartridge holder 71 (see FIG. 9) whether the ink cartridge is compatible with the cartridge holder before the printer-side ink supply needle 72 (see FIG. 9) penetrates the ink supply port 4 (i.e., before the air valve described below opens)

A through-hole 60 is disposed in chamber wall 8*a* of the valve chamber 8 (air chamber 501) as an air hole that opens and closes in conjunction with opening and closing of the air valve 601. The operating arm 66 is disposed on one side of the opening to through-hole 60 and the air valve 601 is disposed at the opening on the other side. The operating arm 66 has an operating part 66*b* for pressing pressurization film (stretch film) 61, and is fixed to the main case 2 at an intervening pivot point 66*a* such that the operating arm 66 proceeds diagonally above into the path of the valve operating rod 70.

The pressurization film 61 is fixed to the chamber wall 8*a* so as to occlude the through-hole 60, and is entirely formed from a rubber or other elastic sheet material. The internal space formed between this pressurization film 61 and the open edge of the through-hole 60 is open to a through-hole 67 communicating with the first ink storage chamber (ink tank) 11 (both shown in FIG. 5)

The air valve 601 has a valve element 65 for opening and closing the through-hole 60, and an elastic member (leaf spring) 62 constantly urging the valve element 65 toward the opening edge of the through-hole 60. A through-hole 62*b* is disposed in the top end part of the elastic member 62, and a projection 64 inserted to this through-hole 62*b* restricts (guides) movement. The bottom end part is fixed to the main case 2 by way of protrusion 63.

Additionally, FIG. 1 illustrates an identification label 88 applied to the top of the main case 2 corresponding to the identification block 87, a film 89 sealing the ink supply port 4 (through-hole 200*a*), and a film 90 sealing the first opening part 85 and second opening part 86.

The ink path and the air path inside this main case 2 are described below with reference to FIG. 1 to FIG. 10.

Ink Path

As shown in FIG. 1 an internal space is formed in the ink cartridge 1 by bonding top case 3 to the front of the main case 2 through intervening internal films (impermeable films) 56, 502, and by bonding protective label 83 to the back side of the main case 2 through intervening impermeable external film 57.

Figure 3:
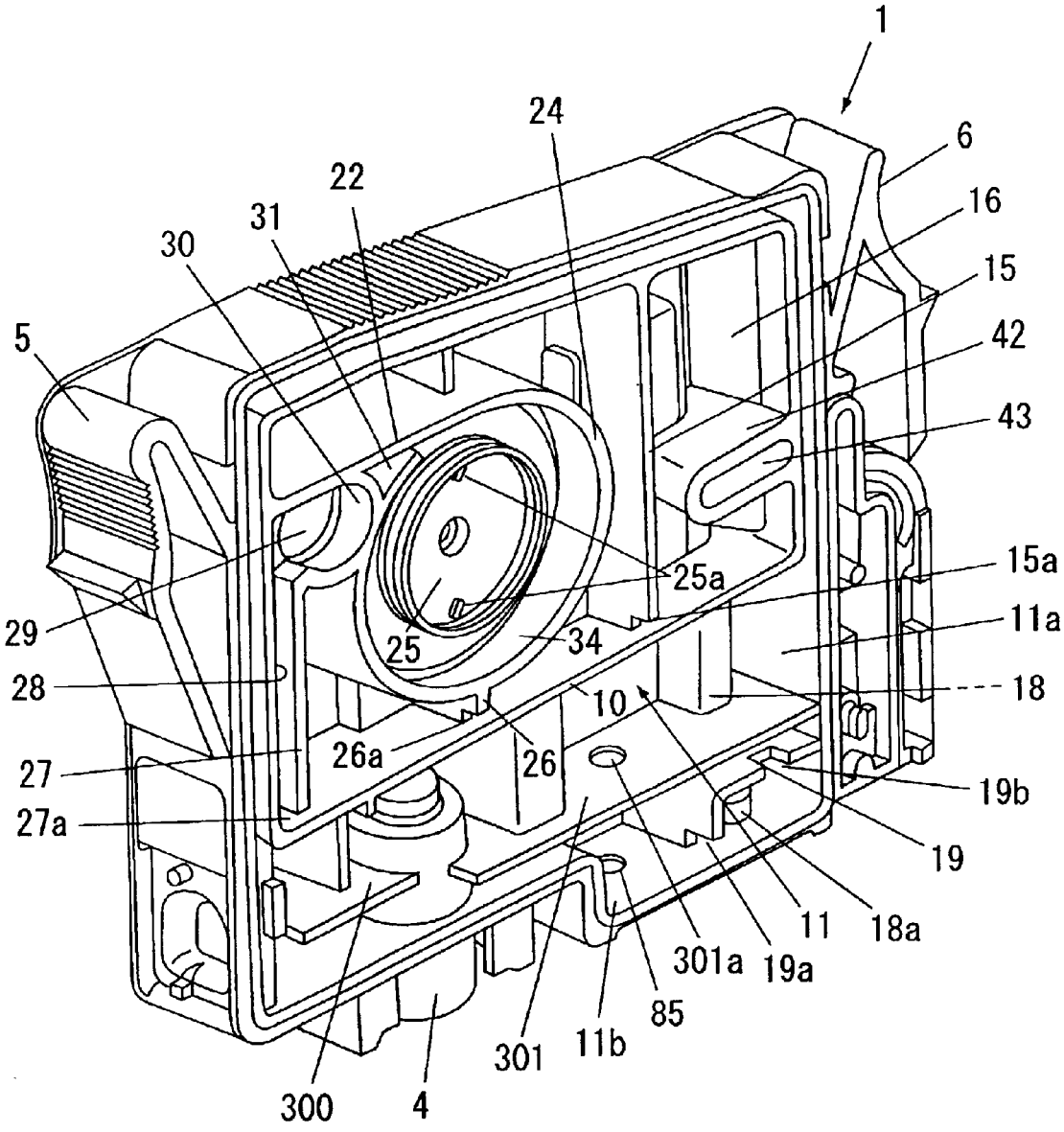
FIG. 3 is an oblique view from above showing the internal structure of an ink cartridge according to an exemplary embodiment of the invention.
Figure 4:
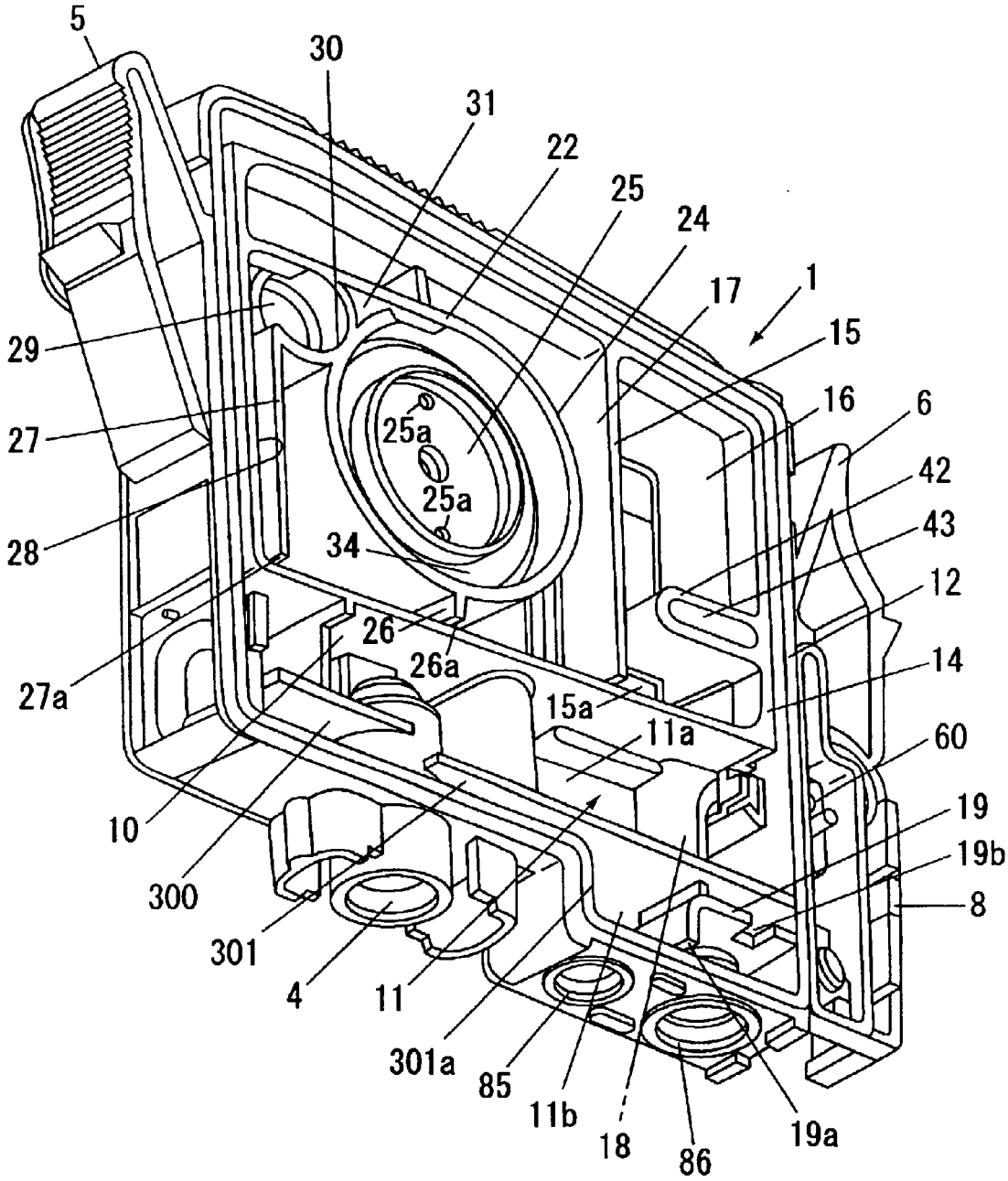
FIG. 4 is an oblique view from below showing the internal structure of an ink cartridge according to an exemplary embodiment of the invention.
Figure 5:
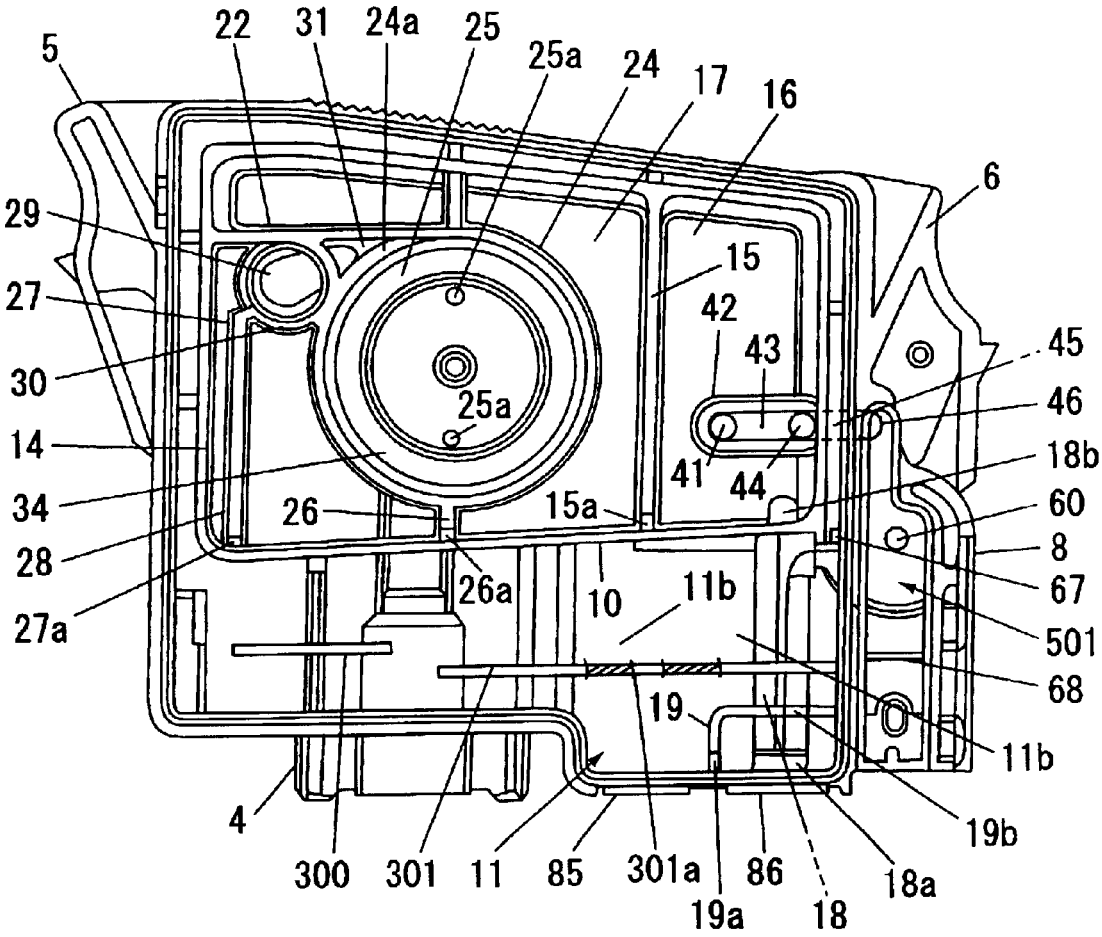
FIG. 5 is a front view showing the internal structure of an ink cartridge according to an exemplary embodiment of the invention.

As shown in FIG. 9, a partition wall 10 disposed so that the end at the ink supply port is slightly lower and segments this internal space into top and bottom parts as shown in FIG. 3 to FIG. 5. The bottom part of this internal space is the first ink storage chamber 11 that is open to the air when connected to the recording head 112.

As illustrated in FIGS. 3–5, two intermediate walls 300, 301 are disposed at different elevations inside the first ink storage chamber 11. The one intermediate wall 300 is disposed with a specific gap to one side wall of the first ink storage chamber 11. The other intermediate wall 301 is on the ink supply port side of the intermediate wall 300 opposite the bottom wall of the first ink storage chamber 11. This intermediate wall 301 divides the first ink storage chamber 11 into two parallel spaces 11*a*, 11*b* in the ink injection direction (vertically). A through-hole 301*a* is disposed in this intermediate wall 301 coaxially to the first opening part 85.

The top part of this internal space is segmented by a frame part 14, of which the bottom part is partition wall 10. The space inside this frame part 14 forms a part of the ink end chamber connecting to the recording head 112. The front side of this ink end chamber is divided into left and right parts by a vertical wall 15 having a communication opening 15*a* formed therein. One side of the internal space thus segmented by vertical wall 15 is the second ink storage chamber 16, and the other side is a third ink storage chamber 17.

A communication path 18 communicating with the first ink storage chamber 11 is connected to the second ink storage chamber 16. This communication path 18 has top and bottom openings 18*a*, 18*b*. The communication path 18 is formed by a vertically extending channel 18*c* (see FIG. 6) open at the back of the main case 2 and an impermeable film (external film 57 as illustrated in FIG. 1) covering and sealing this channel 18*c*. A partition wall 19 with two vertically arranged openings 19*a*, 19*b* communicating with the inside of first ink storage chamber 11 is disposed at the upstream side of the communication path 18. One opening 19*a* is located at a position open to the bottom part of the first ink storage chamber 11, and the other opening 19*b* is located at a position open to the top part of the first ink storage chamber 11.

Figure 6:
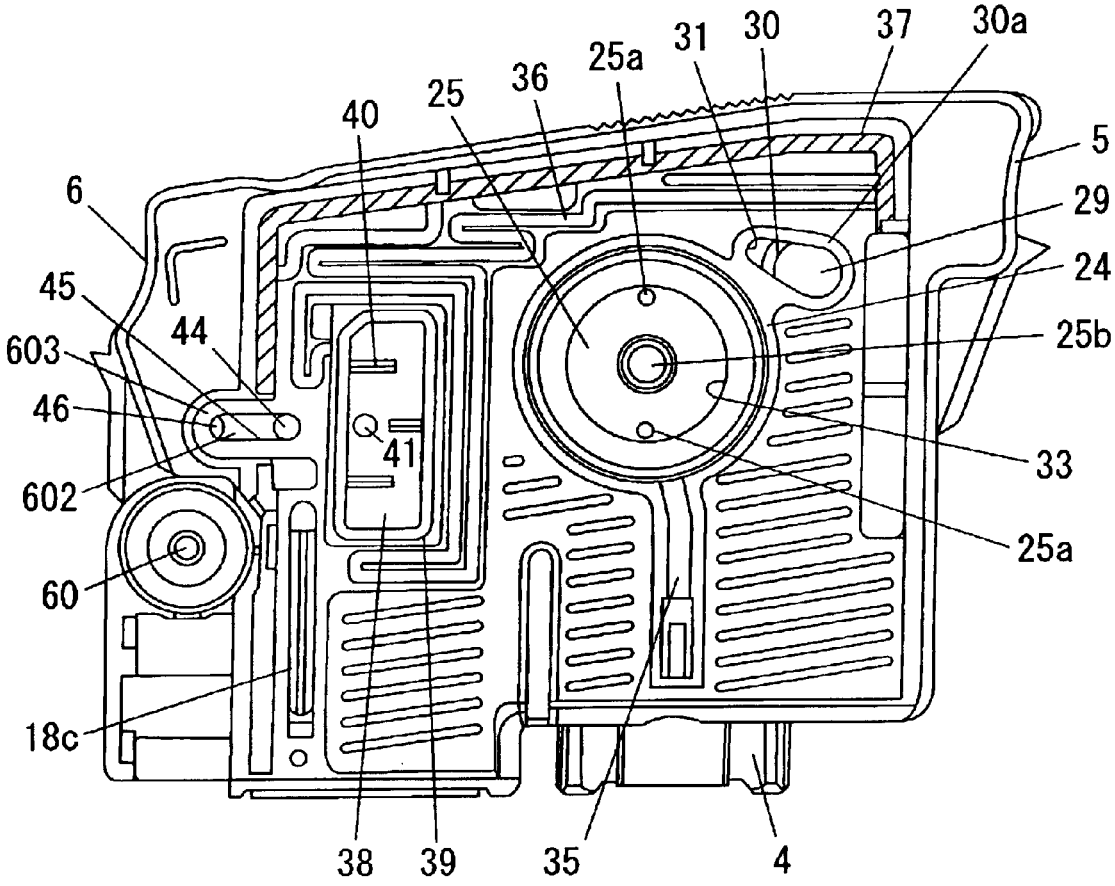
FIG. 6 is a back view showing the internal structure of an ink cartridge according to an exemplary embodiment of the invention.
Figure 7:
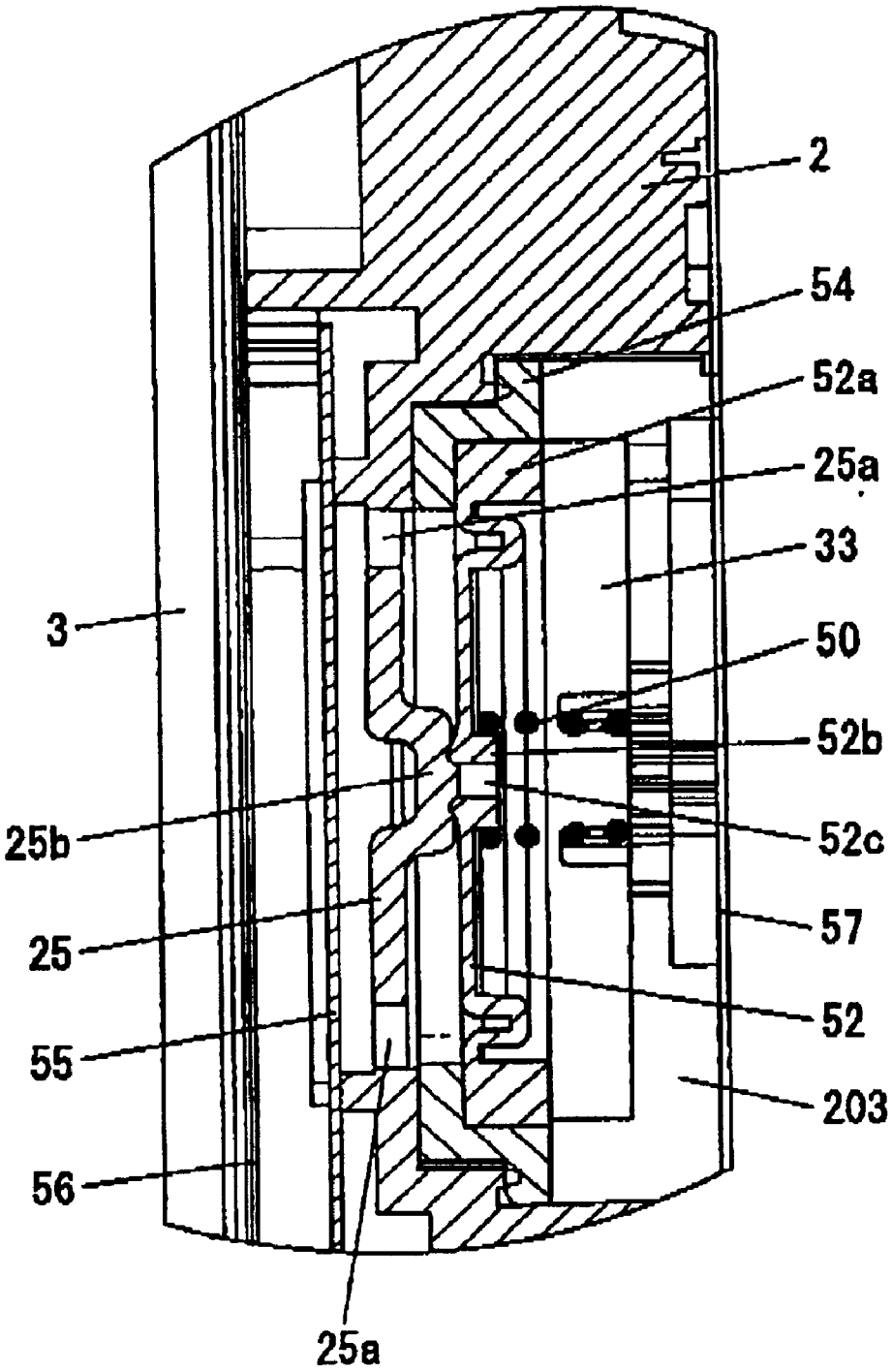
FIG. 7 is an enlarged section view showing the third ink storage chamber in an ink cartridge according to an exemplary embodiment of the invention.

A differential pressure valve chamber 33 (see FIG. 6) for holding the differential pressure valve 52 (membrane valve) shown in FIG. 7, and a filter chamber 34 (see FIG. 5) for holding the filter 55 (felt filter) shown in FIG. 7 are formed in the third ink storage chamber 17 by a longitudinal partition wall 22 and an annular partition wall 24. Through-holes 25*a* for conducting ink passed by the filter 55 from the filter chamber 34 to the differential pressure valve chamber 33 are disposed in partition wall 25.

A partition wall 26 with a communication opening 26*a* between the partition wall 26 and partition wall 10 is disposed at the bottom of partition wall 24, and a partition wall 27 with a communication opening 27*a* between it and the frame part 14 is disposed at the side of partition wall 24. A vertically extending communication path 28 open to communication opening 27*a* is formed between partition wall 27 and frame part 14. A through-hole 29 communicating with the filter chamber 34 through opening 24*a* and area 31 is formed contiguously to this communication path 28.

This through-hole 29 is formed by a partition wall (annular wall) 30 contiguous to partition wall 27.

Area 31 is formed by partition walls 22, 24, 30, and 30*a* (see FIG. 6). This area 31 is formed so that it is deep at the end toward the side of main case 2 (the part communicating with through-hole 29) and shallow at the other end (the part communicating with filter chamber 34)

As shown in FIG. 7 an elastomer or other type of membrane valve 52 is housed in differential pressure valve chamber 33 as an elastically deformable differential pressure valve. This membrane valve 52 has a through-hole 52*c*, is urged to the filter chamber side by a coil compression spring 50, and the perimeter thereof is fixed through a thick annular lip 52*a* to the main case 2 by ultrasonic welding. One end of the coil compression spring 50 is supported by the spring seat 52*b* of membrane valve 52, and the other end is supported by the spring seat 203 inside the differential pressure valve chamber 33.

A frame part 54 is also formed integrally to the thick lip part 52*a* of the membrane valve 52.

As also shown in FIG. 7 filter 55 is placed in filter chamber 34 to pass the ink and capture any dust or foreign matter in the ink. The opening to this filter chamber 34 is sealed by internal film 56, and the opening to the differential pressure valve chamber 33 is sealed by the external film 57.

When the pressure inside ink supply port 4 drops, membrane valve 52 separates from valve seat 25*b* in resistance to the urging force of the coil compression spring 50 and through-hole 52*c* opens. Ink passed by the filter 55 therefore passes through-hole 52*c*, and flows to the ink supply port 4 through the path formed by channel 35. When the pressure inside ink supply port 4 rises to a specific level, the membrane valve 52 is seated to the valve seat 25*b* by the force of coil compression spring 50, and ink flow is thereby stopped. Ink is supplied to the ink supply port 4 while maintaining a specific negative pressure by repeating this operation.

Air Path

As shown in FIG. 6, a zigzag channel 36 for increasing flow resistance, a wide recessed channel 37 (shaded in the figure) open to the air, and a flat, substantially square cavity 38 (space) leading to the first ink storage chamber 11 (see FIG. 5) are disposed on the back side of the main case 2. A frame part 39 and ribs 40 are disposed inside the cavity 38, and an air permeable film 84 (see FIG. 1) is stretched over the aforementioned elements to form an air permeable chamber. A through-hole 41 formed in the bottom (wall part) of the cavity 38 communicates with a long narrow region 43 formed by a partition wall 42 in second ink storage chamber 16 (see FIG. 5).

Region 43 communicates through a through-hole 44 with communication channel 45 formed by partition wall 603 and with air chamber 501 (see FIG. 8) through a through-hole 46 open to the communication channel 45. The open part of this air chamber 501 is sealed by the impermeable internal film 502 shown in FIG. 1.

When an ink cartridge 1 is loaded to the cartridge holder 71 as shown in FIG. 9, the valve operating rod 70 of cartridge holder 71 contacts the operating arm 66 shown in FIG. 8, thus moving the operating part 66*b* (pressurization film 61) to the valve element side. The valve element 65 thus separates from the open edge of through-hole 60, and the first ink storage chamber 11 shown in FIG. 5 opens to the cavity 38 shown in FIG. 6 (i.e., to the air) by way of through-holes 67, 60, and 46, communication channel 45, through-hole 44, region 43, and through-hole 41. The valve element 201 in ink supply port 4 is also opened by inserting the ink supply needle 72.

When valve element 201 in ink supply port 4 opens, ink is consumed by the recording head 112, and the pressure inside ink supply port 4 drops below a specified level, membrane valve 52 inside differential pressure valve chamber 33 (see FIG. 7) opens (membrane valve 52 closes when the pressure in ink supply port 4 rises to a specified level), and ink inside the differential pressure valve chamber 33 flows through ink supply port 4 to the recording head 112.

As the recording head 112 continues to consume ink, ink from the first ink storage chamber 11 flows through the communication path 18 shown in FIG. 4 to the second ink storage chamber 16.

As ink is consumed, air also flows in from through-hole 67 in communication with the air (see FIG. 5), and the ink level in the first ink storage chamber 11 drops. When ink is consumed to the point where the ink level reaches opening 19*a*, ink flows together with air from the first ink storage chamber 11 (which is open to the air through through-hole 67 when ink is supplied) through the valve chamber 8 into the second ink storage chamber 16. Because buoyancy causes the air bubble to rise, only the ink flows through communication opening 15*a* in the bottom part of vertical wall 15 and into third ink storage chamber 17, passes from third ink storage chamber 17 through communication opening 26*a* in partition wall 26 and rises in communication path 28, and then flows from communication path 28 through area 31 and opening 24*a* into the top part of the filter chamber 34.

Ink inside the filter chamber 34 then passes filter 55 shown in FIG. 7 and flows from through-hole 25*a* to differential pressure valve chamber 33, and after passing through-hole 52*c* of membrane valve 52 separated from valve seat 25*b*, drops through channel 35 shown in FIG. 6, and flows into the ink supply port 4.

Ink is thus supplied from the ink cartridge 1 to the recording head 112.

If a different type of ink cartridge 1 is loaded to the cartridge holder 71, identification protrusion 68 (shown in FIG. 8) contacts cartridge holder identification piece 73 (see FIG. 9) before the ink supply port 4 reaches the ink supply needle 72, and thus prevents entry of the valve operating rod 70. Problems caused by loading a different type of ink cartridge can thus be prevented. Furthermore, because the valve operating rod 70 does not reach the operating arm 66 at this time, valve element 65 is held closed and evaporation of the solvent from ink in the first ink storage chamber 11 is prevented.

When the ink cartridge 1 is removed from the cartridge holder 71 loading position, operating arm 66 loses the support of valve operating rod 70 and thus returns elastically. Valve element 65 also returns in conjunction with operating arm 66, thus closing the through-hole 60 and cutting off communication between cavity 38 and first ink storage chamber 11.

A storage method for ink cartridges 1 according to the present invention is described next with reference to FIG.

10. It should be noted that after ink is injected to the ink cartridge 1, the ink supply port 4 is sealed with film 89 and first opening part 85 and second opening part 86 are sealed (airtight) by film 90.

An ink cartridge 1 according to the present invention is stored as shown in FIG. 10 by first storing the ink cartridge 1 inside vacuum pack 91 so that the ink supply port 4 is to the top, and then storing this assembly, that is, the ink cartridge sealed inside the vacuum pack, inside an individual box 92 so that the ink supply port 4 is still positioned at the top. The ink cartridge 1 is inserted to the individual box 92 with reference to the label area 92*c*. It is thus possible to reliably store the ink cartridge 1 inside the individual box 92 50 that the ink supply port 4 remains positioned at the top.

It should be noted that while the label area 92*c* typically contains such text or numbers as the name and address of the manufacturer or a product code, other text or symbols used especially to aid correct positioning of the ink cartridge 1 in the box could also be used.

When an ink cartridge 1 (thus packaged is removed and loaded to the recording head 112, the ink cartridge 1 is inverted and the orientation thereof thus changed. That is, fitting the ink cartridge 1 to the recording head 112 causes the ink supply port 4 to move from this top storage position to the bottom. This also positions the ink end chamber (including third ink storage chamber 17 and second ink storage chamber 16) at the top and the first ink storage chamber 11 at the bottom. Ink from the high density ink layer formed at the bottom of the ink inside the chambers thus flows to the top, ink from the low density ink layer at the top flows to the bottom, and the ink inside the chambers is thus mixed.

When ink supply to the recording head 112 then starts, ink inside the ink tank chamber (differential pressure valve chamber 33) flows through through-hole 52*c* when the differential pressure valve (membrane valve) 52 opens, passes channel 35, and enters the ink supply port 4.

In addition, ink inside the first ink storage chamber 11 flows from opening 19*a* through opening 18*a* and into communication path 18, and from opening 19*b* through opening 18*a* and into the communication path 18. Ink flowing into the communication path 18 thus merges and mixes, rises inside the communication path 18 and flows toward the second ink storage chamber 16.

Because openings 19*a* and 18*a* are at the same height, ink is conducted from the first ink storage chamber 11 by communication path 18 to the second ink storage chamber 16 with no residual ink left in the first ink storage chamber 11.

Next, ink flowing from first ink storage chamber 11 through communication path 18 into the second ink storage chamber 16 merges and mixes with ink in the second ink storage chamber 16. This mixed ink then passes communication opening 15*a* of vertical wall 15 as it flows into and mixes in the third ink storage chamber 17, and then passes communication opening 26*a* of partition wall 26. The ink passed through communication opening 26*a* of partition wall 26 then passes opening 27*a* in partition wall 27, rises through communication path 28, and flows from opening 24*a* through filter chamber 34 into the differential pressure valve chamber 33.

Ink inside ink cartridge 1 stored in individual box 92 according to the present invention is thus coincidentally mixed when the ink cartridge 1 is removed and installed to the recording head 112. Consistent print density and quality can thus be assured when the ink is used. This is particularly beneficial when the ink is a pigment ink, for example, susceptible to a density gradient.

Figure 11:
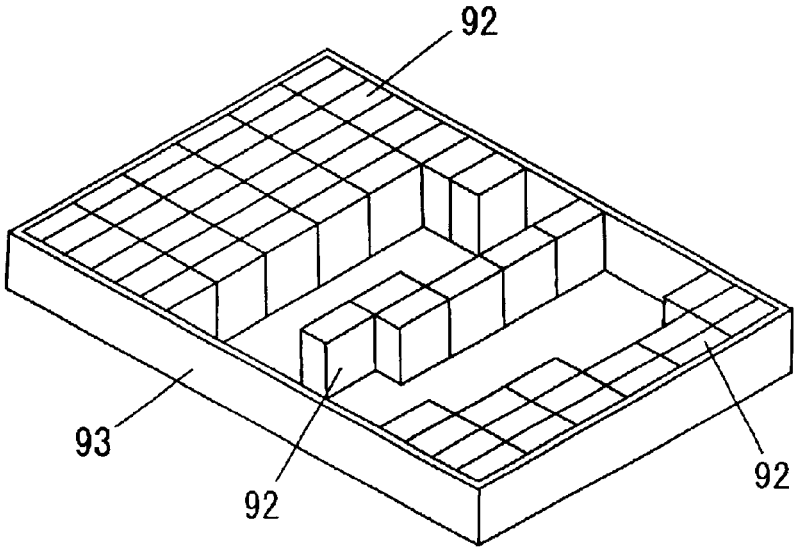
FIG. 11 shows a method of filling packages with an ink cartridge and boxing the packages for shipping according to an exemplary embodiment of the present invention.

When shipping numerous individual boxes 92 each containing an ink cartridge 1, the individual boxes 92 are placed in a shipping box 93 as shown in FIG. 11 so that the ink supply ports 4 are positioned up. This assures that when an individual box 92 is removed from the shipping box 93 and inverted, the ink cartridge 1 inside the individual box 92 is also inverted and the ink inside the ink cartridge 1 is mixed.

Figure 12A:
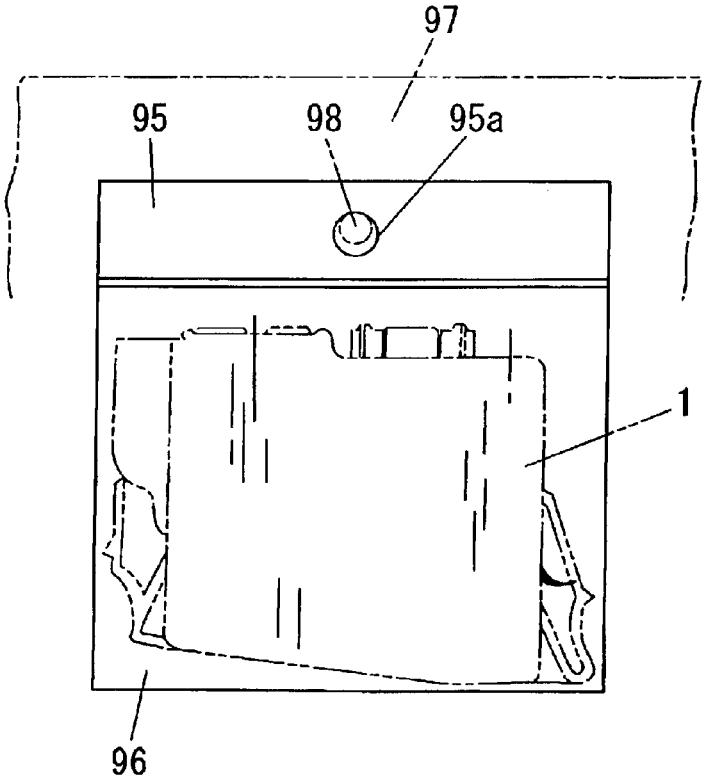
FIGS. 12(*a*) and (*b*) show an alternative package for storing an ink cartridge according to an exemplary of the present invention for shipping and display.
Figure 12B:
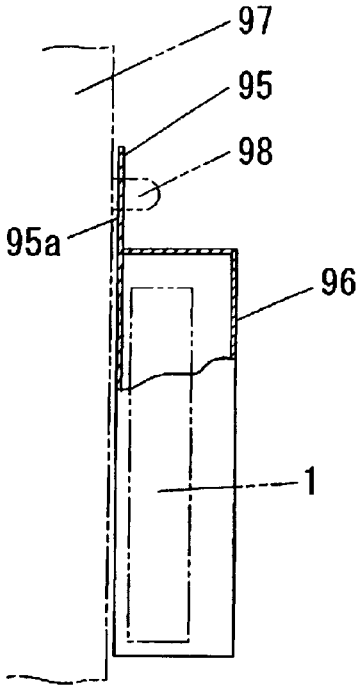

It will also be noted that while the individual box 92 is described above as being square, the present invention shall not be so limited. The individual box 96 could, for example, have a tab 95 with a hole 95*a* as shown in FIG. 12. In this case the hole 95*a* in the tab 95 could be passed over a hanger 98 on a wall 97 or other display stand, for example, for display purposes in a display or retail store. In this case the ink cartridge 1 can be reliably displayed with the ink supply port 4 positioned at the top.

The ink cartridge of the present invention has been described with the inside of the cartridge segmented into top and bottom internal chambers, but the invention shall not be so limited and can be applied to an ink cartridge having only a single internal chamber.

The above-described exemplary embodiment and its variants as would be understood by one skilled in the art have various advantages. For example, but not by way of limitation, the ink cartridge storage structure and method of the present invention thus enables ink inside the cartridge to be mixed coincidentally with inversion of the ink cartridge for installation to the cartridge holder so that consistent print density and quality can be assured when the ink is used.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An ink cartridge storage structure comprising:

an ink-filled ink cartridge having an ink supply port, and an ink storage part for holding only ink; and a packaging for storing the ink cartridge, wherein the ink is stored in an orientation different from a position in which the ink cartridge is used, wherein the ink cartridge is stored in the packaging so that the ink supply port is positioned at a top side, and wherein the ink inside the ink cartridge is a pigment ink.

2. The ink cartridge storage structure according to claim 1, wherein the ink storage part comprises an ink tank chamber and an ink end chamber.

3. The ink cartridge storage structure according to claim 1, wherein the packaging is a vacuum pack.

4. The ink cartridge storage structure according to claim 1, wherein the packaging comprises an individual box.

5. The ink cartridge storage structure according to claim 1, wherein the packaging includes a hanging part with a hangar hole therein.

6. The ink cartridge storage structure according to claim 1, wherein the packaging is packaging enabling storage in an external box for shipping.

7. The ink cartridge storage structure according to claim 1, wherein the packaging has a label part formed thereon for identifying top and bottom parts of the packaging.

8. The ink cartridge structure according to claim 1, wherein said ink cartridge comprises:

an ink path configured to release ink when said cartridge is installed to said recording head; and an air path that releases air into said ink path based on a negative pressure in said ink path.

9. The ink cartridge structure according to claim 8, wherein said air path comprises an air valve that permits air intake via an air hole when said cartridge is installed to said recording head.

10. The ink cartridge structure according to claim 8, wherein said air flows into a storage chamber of said ink path, based on said negative pressure, to displace discharged ink.

11. The ink cartridge structure according to claim 8, wherein said air path of said cartridge comprises:

an airflow channel within said cartridge, configured to increase airflow resistance;

a wide, recessed channel connected to said airflow channel; and an air permeable film stretched over said air path to form an air permeable chamber in said cartridge.

12. The ink cartridge structure according to claim 11, wherein said airflow channel comprises a zigzag channel.

13. An ink cartridge storage method comprising:

positioning an ink-filled ink cartridge having an ink supply port and an ink storage part for holding only ink in a packaging for storing the ink cartridge, wherein the ink cartridge is stored in an orientation different from a position in which the ink cartridge is used, wherein the ink cartridge is stored in the packaging so that the ink supply port is positioned at a top side, and wherein the ink inside the ink cartridge is a pigment ink.

14. The ink cartridge storage method according to claim 13, wherein the packaging is a vacuum pack.

15. The ink cartridge storage method according to claim 13, wherein the packaging is an individual box.

16. The ink cartridge storage method as described in claim 13, further comprising placing the ink cartridge in the packaging with reference to a label part previously formed on the packaging.

17. The method according to claim 13, further comprising:

an ink path releasing ink when said cartridge is installed co said recording head; and an air path releasing air into said ink path based on a negative pressure in said ink path.

18. The method according to claim 17, wherein said air path releasing comprises an air valve permitting air intake via an air hole when said cartridge is installed to said recording head.

19. The method according to claim 17, said air path releasing comprising said air flowing into a storage chamber of said ink path, based on said negative pressure, to displace discharged ink.

20. The method according to claim 17, wherein said air path releasing comprises:

increasing airflow resistance via an airflow channel within said cartridge; and transporting air through a wide, recessed channel connected to said airflow channel, wherein an air permeable film is stretched over said air path to form an air permeable chamber in said cartridge.

21. The method according to claim 20, wherein said increasing airflow resistance comprises channeling air through a zigzag channel.

22. An ink cartridge storage method comprising a step of positioning an ink-filled ink cartridge having an ink supply port and an ink storage part for holding only ink in a packaging for storing the ink cartridge, wherein the ink cartridge is stored with the ink supply port positioned on a first side and wherein when the ink cartridge is installed for usage, the ink supply port is positioned on a second side opposite of said first side.

23. The ink cartridge storage method of claim 22, wherein the first side is a top side of the ink cartridge and the second side is a bottom side of the ink cartridge and wherein when fitting the ink cartridge into a recording head, the ink inside the ink cartridge is mixed.

* * * * *